US012082660B1

(12) United States Patent
Menichino, II

(10) Patent No.: US 12,082,660 B1
(45) Date of Patent: Sep. 10, 2024

(54) STRAP ASSEMBLY AND SYSTEM

(71) Applicant: Andrew Carmen Menichino, II, Canadian Lakes, MI (US)

(72) Inventor: Andrew Carmen Menichino, II, Canadian Lakes, MI (US)

(73) Assignee: Strapsall L.L.C., Stanwood, MI (US)

( * ) Notice: Subject to any disclaimer, the term of this patent is extended or adjusted under 35 U.S.C. 154(b) by 0 days.

(21) Appl. No.: 18/323,746

(22) Filed: May 25, 2023

Related U.S. Application Data

(60) Provisional application No. 63/365,300, filed on May 25, 2022.

(51) Int. Cl.
*A44B 18/00* (2006.01)
*A44B 13/00* (2006.01)

(52) U.S. Cl.
CPC ..... *A44B 13/0005* (2013.01); *Y10T 24/2708* (2015.01)

(58) Field of Classification Search
CPC . Y10T 24/1397; Y10T 24/27; Y10T 24/2708; Y10T 24/316; Y10T 24/314; Y10T 24/318; A44B 18/0003; A44B 18/00; A44B 13/0005; B21D 39/00
See application file for complete search history.

(56) References Cited

U.S. PATENT DOCUMENTS 3,015,896 A * 1/1962 Breslow ..... A43C 11/002 2/919
3,174,787 A 3/1965 Kolman
3,390,680 A * 7/1968 Marcum ..... A61B 17/1322 2/311
3,403,427 A * 10/1968 Asseo ..... A41F 1/00 24/304
4,149,540 A 4/1979 Hasslinger
4,177,807 A 12/1979 Ocel et al.
5,142,743 A 9/1992 Hahn
5,289,619 A 3/1994 Pileggi
5,634,245 A * 6/1997 Rouser ..... A44B 18/0053 24/584.1
5,636,503 A 6/1997 Kaspszyk
6,049,953 A * 4/2000 McCay ..... F16B 45/034 24/302
6,357,084 B1 * 3/2002 Haidon ..... A45C 1/00 24/3.12
6,606,768 B2 8/2003 Henry et al.
8,371,001 B2 2/2013 Vass
9,242,590 B2 * 1/2016 Preston ..... B60P 7/0823
10,167,884 B2 1/2019 Bulat
11,247,742 B2 2/2022 Avolio
2003/0074770 A1 * 4/2003 Roscow ..... B65F 1/06 24/306
2007/0212975 A1 9/2007 Ausman
(Continued)

*Primary Examiner* — Robert Sandy
*Assistant Examiner* — Michael S Lee
(74) *Attorney, Agent, or Firm* — Dunlap Bennett & Ludwig, PLLC

(57) ABSTRACT

A strap assembly providing an elongated, planar elastomeric body extending between a first end and a second end, wherein a first detachable fastener is directly fixed to the first end, wherein a second detachable fastener is directly fixed to the second end, and wherein the first and second detachable fasteners removably attach to each other. One or both of the detachable fasteners may have attachment points for connecting other types of connectors.

4 Claims, 5 Drawing Sheets

(56) References Cited

U.S. PATENT DOCUMENTS

| | | | | |
|---|---|---|---|---|
| 2008/0127461 | A1 | 6/2008 | Linden et al. | |
| 2009/0241300 | A1* | 10/2009 | Ferguson | F16G 11/02 24/306 |
| 2011/0214256 | A1 | 9/2011 | Stone | |
| 2014/0081211 | A1 | 3/2014 | Laird | |
| 2014/0130310 | A1 | 5/2014 | Roth | |
| 2014/0215764 | A1* | 8/2014 | Sung | A45F 5/00 24/3.13 |
| 2017/0209768 | A1* | 7/2017 | Ratthe | A63C 1/42 |
| 2018/0020781 | A1 | 1/2018 | McNeill | |
| 2018/0213920 | A1 | 8/2018 | Uzomba | |
| 2019/0357661 | A1 | 11/2019 | Walters, Jr. | |

* cited by examiner

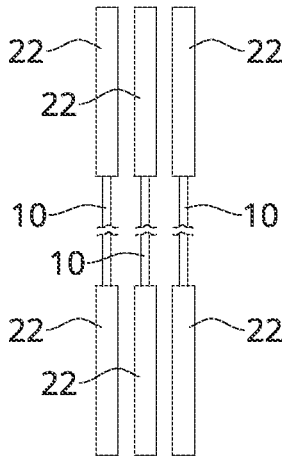
FIG.11
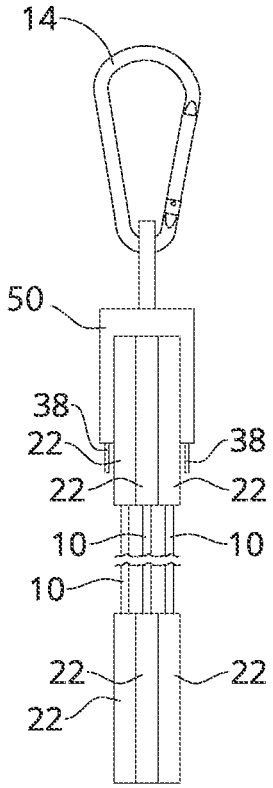
FIG.12
FIG.13
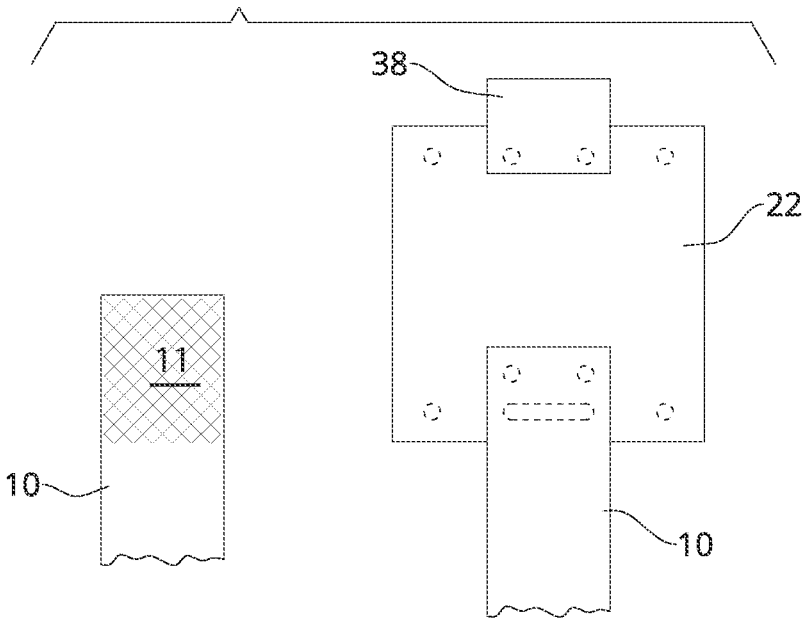

STRAP ASSEMBLY AND SYSTEM

CROSS-REFERENCE TO RELATED APPLICATION

This application claims the benefit of priority of U.S. provisional applications—No. 63/365,300, filed May 25, 2022, the contents of each are herein incorporated by reference.

BACKGROUND OF THE INVENTION

The present invention relates to strap assemblies and systems and, more particularly, a strap assembly having an elastic, elongated body that provides detachable fasteners on each opposing end of the body for selectively stacking a plurality of strap assemblies for adjustably varying the strength when tethering, hanging, and carrying different objects. The strap assembly provides a jaw portion that sandwiches a stacked arrangement of the detachable fasteners.

Straps are often difficult to use, difficult to store, difficult to combine in a stacked arrangement, and expensive. Existing hook and loop straps do not grip the object, they only wrap around and are by nature slippery (like nylon and polyester) and only provide mechanical tension that is complicated to apply and so easy to over-apply. Typical hook and loop straps are not strong and do not provide enough tension to grip and hold objects in place. Other buckle straps with ratchet functionality are cumbersome, tangle to readily and tend to malfunction.

As can be seen, there is a need for a strap assembly having an elastic, elongated body that provides detachable fasteners on each opposing end of the body for selectively stacking a plurality of strap assemblies for adjustably varying the strength when tethering, hanging, and carrying different objects. The strap assembly provides a jaw portion that sandwiches a stacked arrangement of the detachable fastener.

SUMMARY OF THE INVENTION

The present invention leverages the natural tension available in rubber latex or EPDM material of the strap assembly's body provides free and constant tension when stretched.

The detachable fasteners at the distal ends of the present invention contemplate hook and loop fastening functionality that provide a strong grip on an object, wherein this functionality is easy and simple for a user to achieve.

The present invention uses materials that are simple and offer free, natural tension and holding power without the use of mechanical buckles, ratcheting mechanisms, and complex manufactured materials which are expensive to buy and produce. The materials used (rubber/rubber blend for the elastic body and hook and loop for the detachable fasteners) and the method of manufacturing herein combine to provide a simple, easy to use, and effective line of strap products that is less expensive to manufacture, thereby providing consumer a cost-effective option against current offerings. The strength and versatility of the strap assembly embodied in the present invention is outstanding, thereby offering a multitude of uses in various sectors and industries.

In one aspect of the present invention, a strap assembly includes the following: an elongated, planar elastomeric body extending between a first end and a second end; a first detachable fastener directly fixed to the first end; and a second detachable fastener directly fixed to the second end, wherein the first and second detachable fasteners removably attach to each other.

In another aspect of the present invention, the strap assembly further includes wherein the elastomeric body is made from rubber, along a shared longitudinal axis, a cross-section of the elastomeric body is less than a cross-section of both the first and second detachable fasteners, wherein the first and second detachable fasteners are hook and loop fasteners, respectively, wherein each detachable fastener comprises a planar sheet that is folded over and directly sandwiching an attachment area of the end of the elastomeric body, wherein the attachment area is an abraded surface, for each detachable fastener, further comprising two pull tabs protruding proximally from the detachable fastener, each pull tab adjacent to an opposing side of the elongated body.

In yet another aspect of the present invention, a strap assembly system includes the following: two or more of the above-mentioned strap assemblies removably connected to each other in a stacked arrangement by way of alternating an orientation of the first and second detachable fasteners of adjacent strap assemblies for the two or more of the strap assemblies, wherein each elastomeric body is in alignment with each other; and a jaw portion comprising two auxiliary detachable fasteners movable between an open condition and a closed condition sandwiching the aligned detachable fasteners of the stacked arrangement, wherein a distal end of the jaw portion provides an attachment point extending away from the aligned elastomeric bodies.

In still yet another aspect of the present invention, a method of making a strap assembly, the method includes abrading a first and second end of an elongated, planer elastomeric body; folding a strip of hook material over the first end so as to form an adhered first sandwich of the first end by way of an adhesive; and folding a strip of loop material over the second end so as to form an adhered second sandwich of the second end by way of the adhesive, wherein a width of each strip is coextensive with each other and greater than a width of the elastomeric body.

These and other features, aspects and advantages of the present invention will become better understood with reference to the following drawings, description, and claims.

BRIEF DESCRIPTION OF THE DRAWINGS

FIG. 11 is a view of an exemplary embodiment of the present invention, shown in a stacked arrangement.

FIG. 12 is a view of the stacked arrangement, illustrating the sandwiching of the plurality of stacked detachable fasteners by way of the jaws 50.

FIG. 13 is a detailed view of an exemplary embodiment of the present invention, illustrating adhering of the end of the elastomeric body 10 to a detachable fastener 22 through a prepared and abraded surface 11.

DETAILED DESCRIPTION OF THE INVENTION

Figure 1:
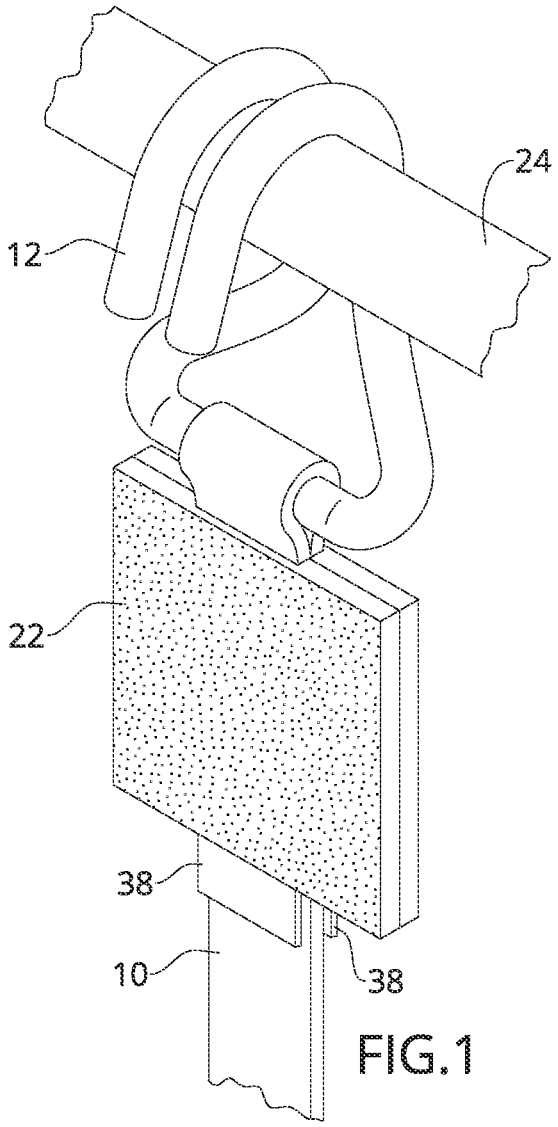
FIG. 1 is a top perspective view of an exemplary embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

The following detailed description is of the best currently contemplated modes of carrying out exemplary embodiments of the invention. The description is not to be taken in a limiting sense but is made merely for the purpose of illustrating the general principles of the present invention.

Referring now to FIGS. 1 through 13, the present invention may include a strap assembly 100. The strap assembly 100 may include an elastomeric body 10 extending between two, opposing detachable fasteners 22.

In some embodiments, each detachable fastener 22 may have an overall planar shape offering two opposing surfaces. On the first surface of each detachable fastener 22 may be a first fastener, while on the opposing second surface may be a second fastener. The first and second fasteners being complementary and so removably connectable to each other. In one embodiment, the first fastener is a hook portion while the second fastener is a loop portion of a hook and loop fastener. In other embodiments, both first and second surfaces of one of the two, opposing detachable fasteners 22 may be the first portion of complementary detachable fasteners, while the other of the two, opposing detachable fasteners 22 is the second portion.

The elastomeric body 10 may be an elongated, planar band. The elastomeric body 10 may be chemically treated and cleaned and mechanically abraded at its ends in contact for rigid adhesion with each detachable fastener 22. By elongated, the length is greater than the width, wherein the width is latitudinal relative the longitudinal axis of the elongated body 10. The abraded portions 11 may be the result of sanding machine or other sanding tool and specific grit sandpaper or metal wire wheel appropriate for the elastomeric material (e.g., rubber that the elastomeric body 10 is comprised of).

A method of manufacture may include wiping the abraded surface area 11 with a chemical wipe comprising of a degreaser and Isopropyl alcohol ten removing the liner from pre-applied rubber or acrylic applied adhesive, before aligning the ends of the elastomeric body 10 to a specific location within the detachable fastener 22 and applying specific amount of structural adhesive to specific locations on the abraded ends of the elastomeric body 10. The manufacturer may then combine the first and second portions of the detachable fastener 22 and place the assembly into a clamping mechanism for a defined period under a defined amount of pressure (for instance, measured in pounds per square inch), and then trim the first and second portions of the detachable fastener 22 so no excess material with adhesive is exposed. If desired, mechanical accessories may be included, including but not limited to a triangular D hook, nylon loop for hooks 12, or grommet holes 26, 28 for hooks, D-ring 20, buckles 18 and the like. Other accessories such as triangular D hooks, clasp hooks 18 and carabiners 14, 16 may be added to the assembly at this time. These items provide additional utility for the consumer allowing the strapped item to be hooked to a backpack, hooked to a garage wall, maintenance crib wall, trailer, pick up, truck bed, etc.

The natural tension available in the elastomeric material of the body 10 provides free and constant tension when stretched, and the detachable fastener 22 fastening functionality combine to provide a strong grip on an object that is easy and simple for the user to achieve. The materials used herein are simple and offer free and natural tension and holding power without the use of mechanical buckles, ratcheting mechanisms, lightweight fastening systems, and complex manufactured materials which are expensive to buy and produce. The materials used (elastomeric material and detachable fastener 22) and the method of manufacturing herein combine to provide a simple, safer than current offerings and easy to use and effective line of strap products that is less expensive to manufacture, thereby providing consumer a cost-effective option against current offerings. The strength and versatility of this assembly affords a multitude of uses in various sectors and industries.

The elastomeric material of the body 10 may be natural rubber band material, rubber composition such as EPDM, or equivalent elastomeric material cut to length and acts as the elongated, planar body 10 to hold objects 32 in place, with green strength (stickiness) inherent to physical properties of rubber. The elastomeric material 20 needs to be mechanically abraded to improve and prepare the surface for adhesion to (through being embedded in) the detachable fastener 22. After abrading, the abraded areas may be cleaned with chemicals to remove any remaining grease, dirt, or debris and to improve the surface energy of the rubber material. The detachable fastener 22 used may be pre-applied with pressure sensitive adhesive useful for bonding to two pieces (i.e., the first and second portions) of the detachable fastener 22 together in the shape of a square, rectangular, or other geometric shape. Alternatively, the detachable fastener 22 may be one piece that is wrapped around, sandwiching the end of the body 10. The detachable fastener 22 may be cut to specific sized (rectangular or the like) planar pads. Alignment and bonding of all the above pieces at both ends of the rubber band material results in the strap assembly 100.

A structural adhesive is expertly applied, specifically: a type, viscosity, and an amount. This information is critical to the end functionality of the strap itself. The structural adhesive bonds the elastomeric material to the pad/body of the detachable fastener 22 which allows this assembly to be useful as a strap. The net result is equal to or surpasses the strength and overall functionality of other similar products.

All the above steps may be repeated for the other end of the rubber band material, thus creating a structurally bonded detachable fastener 22 (of specific size) at each end of the body 10. Should a grommet hole be required, there is available space designed into the grommeted detachable fastener 26 to accommodate for this feature which provides a grommet hole at each end of the grommeted detachable fastener 26 which allows a consumer the option of hanging or hooking to another object for storage or transport while the object is being held under tension by the strap.

The two opposing detachable fasteners on each end of the elongated, planar elastomeric body 10 enables a user to connect the two free ends of the to make a circular arrangement to serve specific purposes. One purpose could be to wrap the elastomeric body 10 around an object 24 to anchor the strap assembly 100 thereto shown in FIG. 7.

Figure 4:
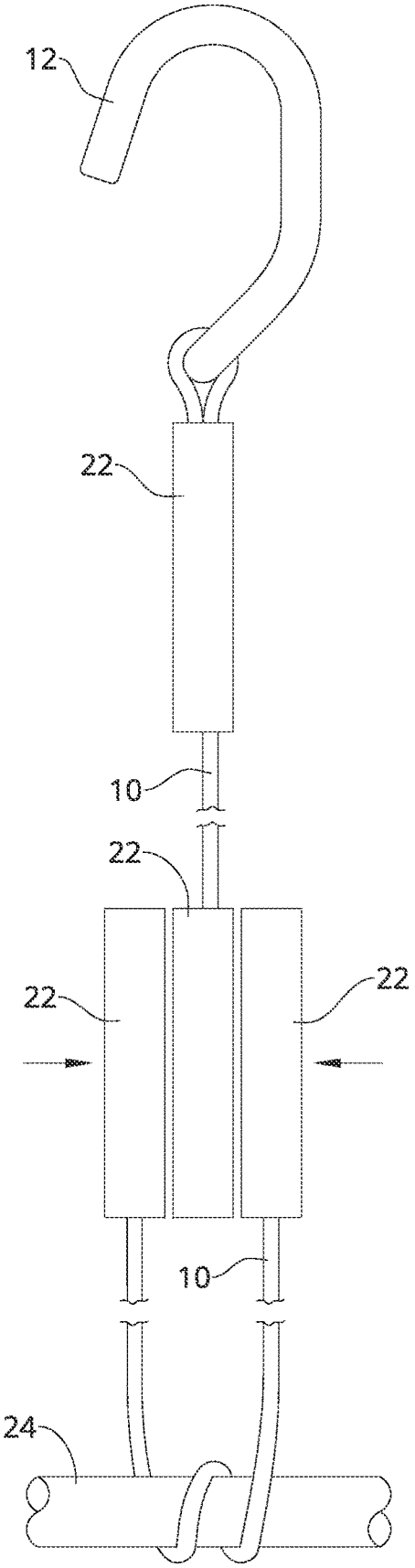
FIG. 4 is an exploded elevation view of an exemplary embodiment of the present invention, shown in use, illustrating formation of a combination of a linear arrangement and a circular/coiling arrangement.
Figure 5:
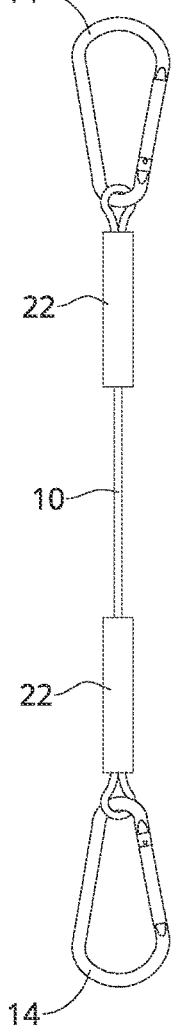
FIG. 5 is an elevation view of an exemplary embodiment of the present invention.
Figure 6:
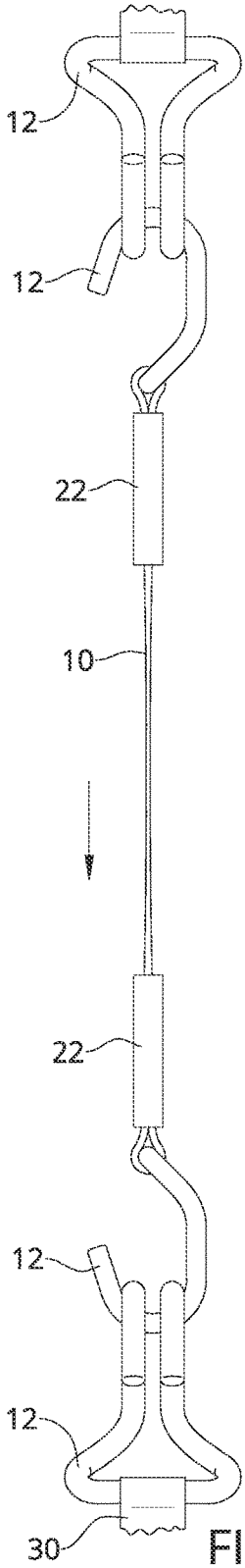
FIG. 6 is an elevation view of an exemplary embodiment of the present invention, shown in use.
Figure 7:
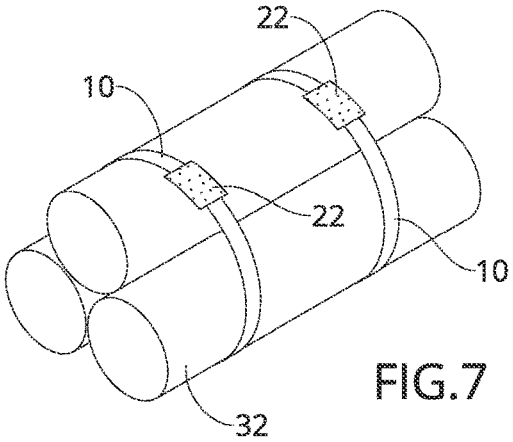
FIG. 7 is a perspective view of an exemplary embodiment of the present invention, shown in use.

Furthermore, two strap assemblies 100 can be joined end to end in a linear arrangement, as illustrated in FIG. 4. FIG. 4 shows a combination of the circular arrangement and the linear arrangement.

The strap assembly 100 may be specifically aligned, mated, or wrapped/folded creating a "sandwich" assembly. The assembly may be placed under a certain amount of pressure for a specified amount of time. The relationship of pressure and time is paramount to the success of the adhesive and assembly.

Referring to FIGS. 11 and 12, a stacked arrangement can be assembled using a plurality of strap assemblies 100. Each strap assembly 100 connects to one or more adjacent strap assembly 100 by way of their respective detachable fasteners 22. Adding each additional strap assembly 100 proportional increases the strength of the stacked arrangement. When the stacked arrangement reaches a desired strength, a user may utilize the jaw portion 50 of the overall strapping system.

Figures 2A, 2B:
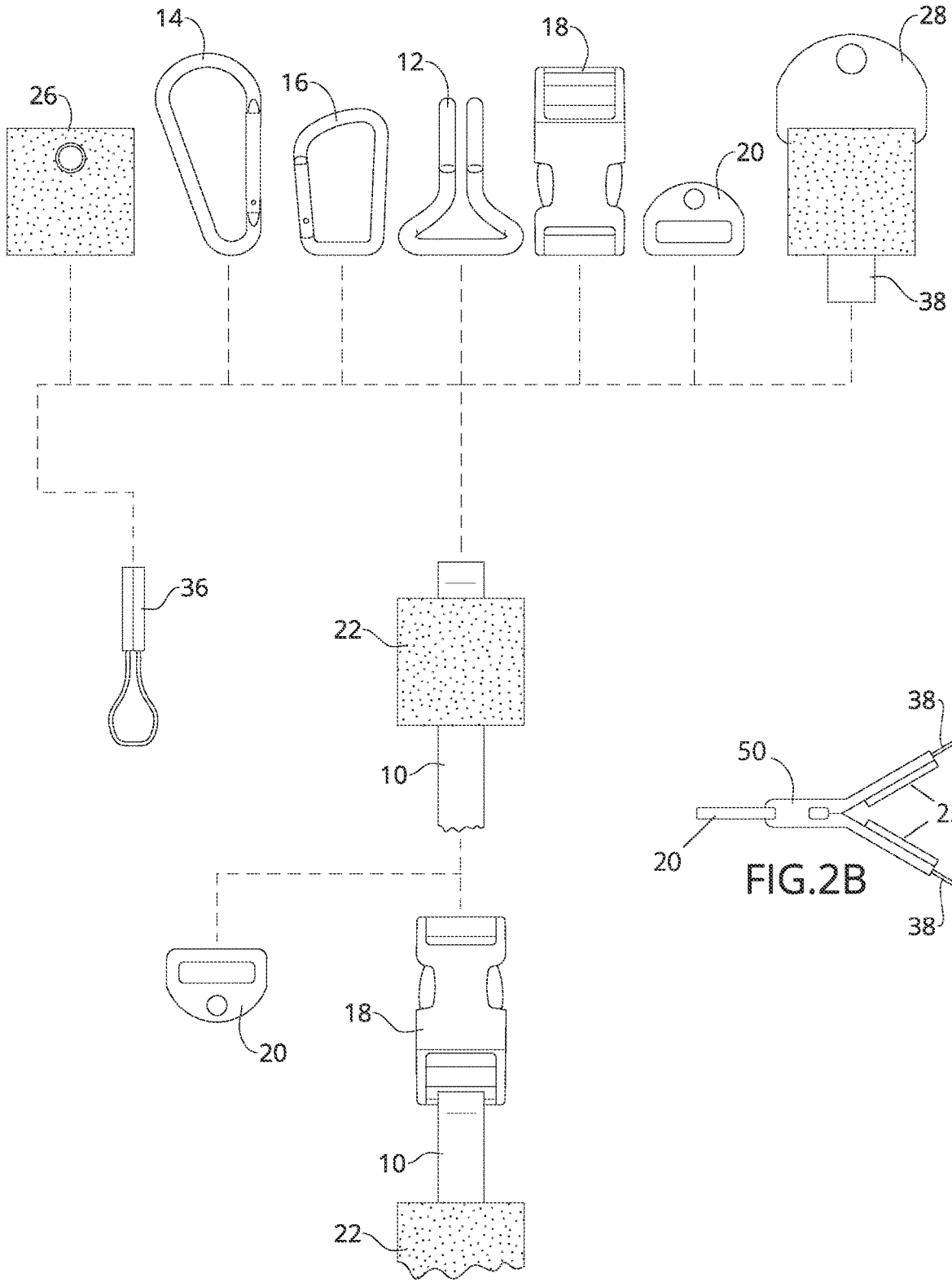
FIG. 2A is an exploded view of an exemplary embodiment of the present invention.
FIG. 2B is an elevation view of an exemplary embodiment of a jaw attachment of the present invention.
Figure 3:
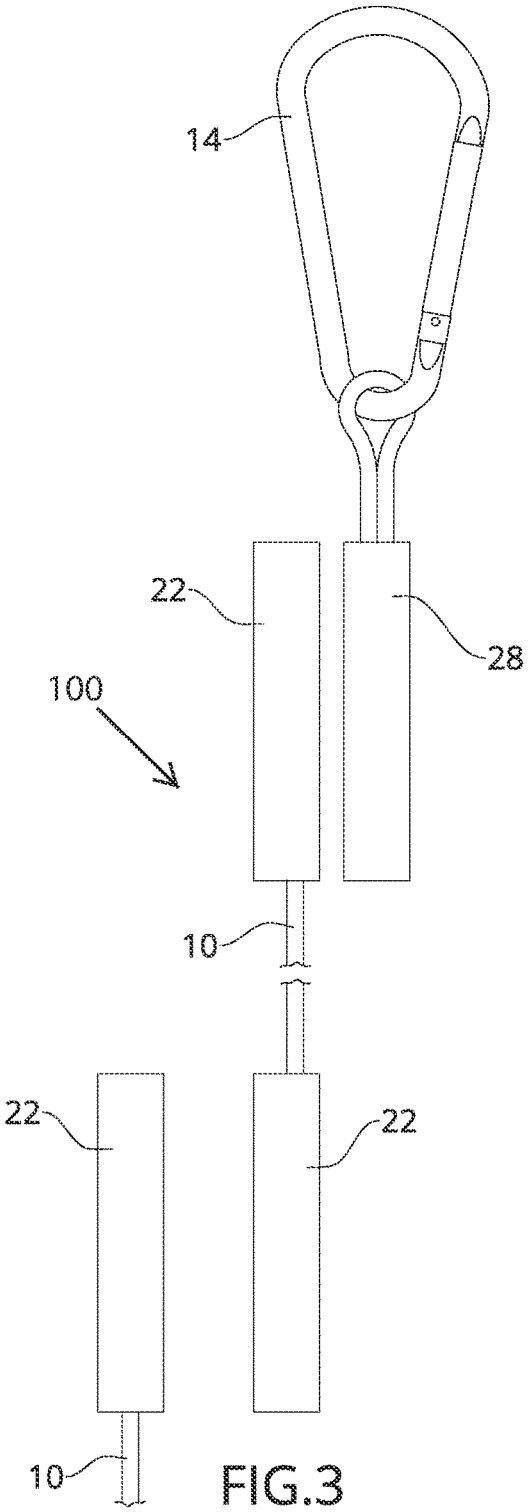
FIG. 3 is an exploded elevation view of an exemplary embodiment of the present invention, illustrating formation of a linear arrangement of the present invention.

The jaw portion 50 provides auxiliary first and second detachable fasteners 23 that complement and removably mate with the detachable fasteners 22. The auxiliary detachable fasteners 23 are movable by way of a pivot point between an open condition (as illustrated in FIG. 2B) and a closed condition where it can sandwich one or more detachable fasteners 22 of one or more strap assemblies 100, as illustrated in FIG. 12. Each detachable fastener may provide a pull tab 38, or alternatively distal ends of the jaw portion 50 may provide a pull tab 38. Along the base of the jaw portion 50, opposite the movable jaw/detachable fasteners 23, a D-ring 20 (or other fastener type) may be provided. Accordingly, when the detachable fastener is sandwiching the detachable fastener(s) 22 of the strap assembly or assemblies 100, the D-ring 20 can be directly or indirectly attached to an object, e.g., by way of a carabiner 14, 16.

The permanently bonded assembly of the elongated planar body 10 with the detachable fastener 22 (both items cut and sized to specification) at each end of the body 10 effectively creates a functional strap mechanism that provides an elastic strap (a material that naturally conforms to the surface shape of the object) with natural tension (free energy to hold) and green strength (to grip without damaging a surface). The elastomeric properties of the elastomeric material allow the user to stretch the body 10 around the object, the elongated planar body 10 will conform to the size (both features are elastomeric properties) and grip the object (green strength of the rubber), and work effectively as a strap product. The detachable fastener 22 at each end of the body 10 material allows the user to lock the tension created by stretching the body 10 into place, thereby holding the object under tension with ability grip the object. The additional accessories allow the user to further utility for hanging, transporting, storing, and holding down an object to another surface.

Each strap assembly 100 of this design can be a multifunctional product with ability to wrap (hook and loop band without any accessories), wrap and carry (hook and loop band with triangle D ring hook and carabiner), wrap and store (hook and loop band with hanger hook), wrap/carry and transport (hook and loop band with clasp), wrap and anchor (hook and loop band with grommet holes), and anchor an object in place (band with grommet holes with a nylon tab replacing the hook and loop) using mechanical fasteners (using the grommet holes).

A method of manufacturing the present invention may include the following. A manufacturer may cut an industrial grade rubber band (various applicable widths and thicknesses suitable for an effective strap) to desired length and prepare the surfaces accordingly through mechanical and chemical abrasion/cleaning. Cut the hook and loop fastener ends (or optional polymeric tab material) according to specification and prepare the product for attachment (two hook pieces on one end and two loop pieces on the other end). Expertly apply structural adhesive to the band and mate the assembly together at each end. Clamp the assembly for a specified amount of time under even pressure covering 100% of the bond line and hook and loop material. Add accessories prior to mating the second hook and loop assembly.

A parts list may include the following:

- Industrial grade Rubber Band material.
- Industrial Grade Hook and Loop material.
- Industrial Grade Structural Adhesives.
- Heavy and Medium Grit Sandpaper and/or metal wire sanding wheel.
- Liquid Chemicals (Isopropyl alcohol and industrial grade degreaser)
- Other mechanical fastener assemblies such as triangular D rings, Carabiner, hooks, metal rivets and clasps.
- Hole Punches.
- Grommet press and grommets.
- Polymeric webbing materials.
- Scissors and/or sliding cutting tool.
- Clamping Mechanism with custom Jigs.
- Various tools for cutting and clamping.
- Tape measures.
- Scale for weighing adhesive.
- Adhesive dispensing equipment.

The steps explained herein need to be followed with precision and expertise, as any deviation from described creates an underperforming product not equal to industry standards/commercially available strapping products. The alternate use of this strap involves switching out the hook and loop with 2 of the same ends (two hook ends or two loop ends) it can be used as an open band that hooks to another surface with similar end affixed at each end.

A method of using the present invention may include the following. A user may wrap and stretch the body 10 around an object creating tension. Using the detachable fastener 22, lock the strap assembly 100 into place when the appropriate amount of tension and grip is achieved. The user can wrap and carry objects while walking, hiking, jogging, etc. Wrap cords and cables; wrap tools and gear, and other household or maintenance items for storage and organizational purposes; hold down items for transport, or from heavy winds. The user can use the strap to hold objects into place by using mechanical fasteners and the grommet holes, as in screwing the strap around the feet of outdoor furniture holding it into place during a windstorm; or as in holding down items in a trailer for transporting; or as in holding down items in a factory for transporting from one part of the factory to another.

Each strap assembly 100 can be produced to be multifunctional allowing all the above activities to take place with one useful strap. The strap assembly 100 may be made to various strength levels according to end use; light duty, medium duty, and heavy duty; and can be made in predetermined lengths or customized lengths according to consumer need. Another option for use is a strap assembly 100 without hook and loop as described which functions as a body 10 with hooks or other hanging mechanisms at each end of the strap.

Figure 8:
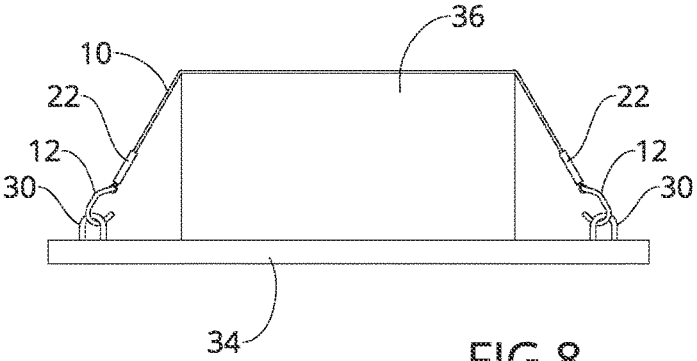
FIG. 8 is an elevation view of an exemplary embodiment of the present invention, shown in use.
Figure 9:
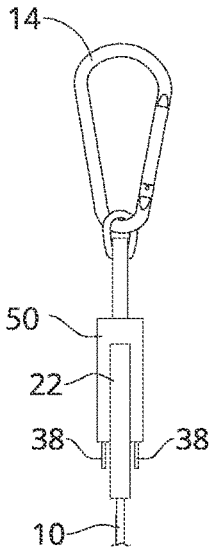
FIG. 9 is an elevation view of an exemplary embodiment of the present invention.
Figure 10:
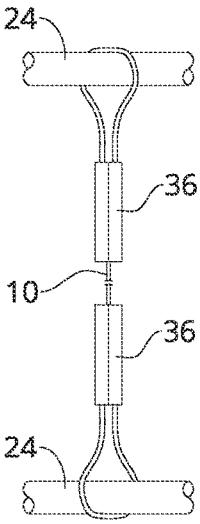
FIG. 10 is an elevation view of an exemplary embodiment of the present invention, shown in use.

Additionally, the strap can be useful in the emergency medical field as a tourniquet; useful as a life and/or limb saving strap where great strength and stretch is useful in emergency situations; holding down dog boots on your pets; sleeping bag straps; military and law enforcement model type gear straps; clamping an item during binding process; hold skis together during transport; a cabinet door safety strap for child proofing; carrying a load of firewood; securing furniture, lawn care equipment, construction materials and tools in a trailer; holding two heavy items together for transport. Many other uses can be mentioned, such as cargo straps, tie downs, as illustrated in FIG. 8, and other such uses as garage organization, furniture hold downs, hurricane straps, etc. When used as a tie down, the user will appreciate the non-marking nature of the rubber strap when compared to a plastic type of material which will often rub into a surface and scar a surface under too much pressure, wind and vibration. When the grommet is used, each end can be mechanically fastened to a trailer side wall or bottom board and permanently hold down an item until the fasteners are removed.

Also, the present invention can create the following: the strap assembly 100 with buckles 18 are used in aftermarket parts for utility vehicles; holding windshields in place and plastic clear dividers in place in Ubers and taxis.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A strap assembly, comprising:

an elongated, planar elastomeric body extending between a first end and a second end;

a first detachable fastener directly fixed to the first end;

a second detachable fastener directly fixed to the second end, wherein the first and second detachable fasteners are removably attachable to each other, wherein along a shared longitudinal axis, a cross-section of the elastomeric body is less than a cross-section of both the first and second detachable fasteners, wherein the first and second detachable fasteners are hook and loop fasteners, respectively, wherein each detachable fastener comprises a planar sheet that is folded over and directly sandwiching an attachment area of the end of the elastomeric body, wherein the attachment area is an abraded surface; and for each detachable fastener, further comprising two pull tabs protruding proximally from the detachable fastener, each pull tab adjacent to an opposing side of the elongated body.

2. The strap assembly of claim 1, wherein the elastomeric body is made from rubber.

3. A strap assembly system comprising:

two or more strap assemblies, wherein each strap assembly comprises:

an elongated, planar elastomeric body extending between a first end and a second end;

a first detachable fastener directly fixed to the first end;

a second detachable fastener directly fixed to the second end, wherein the first and second detachable fasteners are removably attachable to each other;

wherein the two or more strap assemblies are removably connected to each other in a stacked arrangement by way of alternating an orientation of the first and second detachable fasteners of adjacent strap assemblies for the two or more of the strap assemblies, wherein each elastomeric body is in alignment with each other; and a jaw attachment comprising two auxiliary detachable fasteners movable between an open condition and a closed condition sandwiching the aligned detachable fasteners of the stacked arrangement.

4. The strap assembly system of claim 3, wherein a distal end of the jaw attachment provides an attachment point extending away from the aligned elastomeric bodies.

* * * * *